US006059958A

United States Patent [19]

Ramos et al.

[11] Patent Number: 6,059,958

[45] Date of Patent: May 9, 2000

[54] PROCESS FOR THE FLUID CATALYTIC CRACKING OF HEAVY FEEDSTOCKS

[75] Inventors: José Geraldo Furtado Ramos, Rio de Janeiro; José Mozart Fusco, Niterói; Moacir José Bampi, Porto Alegre; Emanuel Freire Sandes, Niiterói; Francisco Carlos Da Costa Barros, Nova Iguaçu; Jorivaldo Medeiros, Rio de Janeiro; Cláudio Fonseca Machado Dos Santos, Rio de Janeiro; Aurélio Medina Dubois, Rio de Janeiro; Ingrid Alexandra Zech, Rio de Janeiro; Mônica Einsfeldt, Petrópolis; Maria Celia Dos Santos Da Rocha, Rio de Janeiro, all of Brazil

[73] Assignee: Petroleo Brasileiro S.A.-Petrobras, Rio de Janeiro, Brazil

[21] Appl. No.: 08/933,006

[22] Filed: Sep. 18, 1997

[30] Foreign Application Priority Data

Jul. 17, 1997 [BR] Brazil ..... 9703632

[51] Int. Cl.[7] ..... C10G 11/00

[52] U.S. Cl. ..... 208/113; 208/153; 208/157; 208/159; 208/160; 208/163; 208/164

[58] Field of Search ..... 208/113, 153, 208/157, 159, 160, 163, 164

[56] References Cited

U.S. PATENT DOCUMENTS

| | | | |
|---|---|---|---|
| 2,819,951 | 1/1958 | Medlin et al. | 23/288 |
| 2,970,117 | 1/1961 | Harper et al. | 252/417 |
| 4,167,492 | 9/1979 | Varady | 252/417 |
| 4,234,411 | 11/1980 | Thompson | 208/74 |
| 4,257,875 | 3/1981 | Lengemann et al. | 208/113 |
| 4,374,750 | 2/1983 | Vickers et al. | 252/417 |
| 4,396,531 | 8/1983 | Lomas | 252/417 |
| 4,578,366 | 3/1986 | Cetinkaya et al. | 502/6 |
| 4,614,726 | 9/1986 | Walters et al. | 502/41 |
| 4,757,039 | 7/1988 | Lomas | 502/41 |
| 5,000,841 | 3/1991 | Owen | 208/113 |
| 5,062,945 | 11/1991 | Pappal et al. | 208/113 |
| 5,346,613 | 9/1994 | Lomas et al. | 208/164 |
| 5,451,313 | 9/1995 | Wegerer et al. | 208/164 |
| 5,462,652 | 10/1995 | Wegerer | 208/167 |
| 5,800,697 | 9/1998 | Lengemann | 208/159 |

FOREIGN PATENT DOCUMENTS 0 724 009 7/1996 European Pat. Off. .

*Primary Examiner*—Walter D. Griffin
*Assistant Examiner*—Nadine Preisch
*Attorney, Agent, or Firm*—Sughrue, Mion, Zinn, Macpeak & Seas, PLLC

[57] ABSTRACT

A process for the fluid catalytic cracking of heavy feeds under a heat balance regime is described, where one or more catalyst coolers external to the regenerator cool a stream of regenerated catalyst. A portion of said stream returns to the regenerator and a portion of the cooled regenerated catalyst is admixed to the non-cooled regenerated catalyst at a temperature substantially lower than the regenerator temperature, said admixture being brought into contact with the hydrocarbon feed to be cracked. As a result, the control of the catalyst circulation is rendered independent from the heat balance of the unit, with minimization of the thermal cracking, and therefore lower coke and fuel gas products.

28 Claims, 3 Drawing Sheets

PROCESS FOR THE FLUID CATALYTIC CRACKING OF HEAVY FEEDSTOCKS

FIELD OF THE INVENTION

The present invention relates to a fluid catalytic cracking process which is improved by intervening in the heat balance. More specifically, the present invention relates to a process for the fluid catalytic cracking where a modification in the concept of the heat balance of the cracking unit makes possible an increased output of the process through improvement in the balance of product yield, mainly in the case of the catalytic cracking of heavy feedstocks. The intervention consists in feeding to the riser two streams of regenerated catalyst, one of the streams being a regenerated catalyst stream at the temperature of the regenerator while the other stream is a cooled stream of regenerated catalyst.

BACKGROUND OF THE INVENTION

Fluid catalytic cracking or FCC is effected by contacting the hydrocarbons in a conversion zone with a catalyst which is made up of a fine particulate material. Opposite to the hydrocracking, the catalytic cracking is effected in the complete absence of added hydrogen or hydrogen consumption. Generally, the most common feeds submitted to the FCC process are those refinery streams originating from side cuts of vacuum towers, called heavy vacuum gasoil, or heavier than those, originating from the bottom of atmospheric towers and called atmospheric residue, or still, mixtures of these streams. These streams, of density typically in the range of 8 to 28° API, should be submitted to a chemical process such as a catalytic cracking, to have their composition deeply altered, so as to be converted into lighter hydrocarbon streams, of higher economic value.

During the cracking reaction, substantial amounts of coke, by-product of the reaction, are deposited on the catalyst. Coke is a high-molecular weight stuff, made up of hydrocarbons which typically contain of from 4 to 8 weight % of hydrogen in their composition. The coke-recovered catalyst, usually called spent catalyst by the experts, is continually removed from the conversion zone and replaced by catalyst essentially free of coke from the regeneration zone. The burning of the coke deposited on the surface and in the pores of the catalyst is effected in the regeneration zone, in a regeneration vessel kept at high temperature. Eliminating coke by combustion allows the recovery of the catalyst activity and releases heat in an amount which is sufficient to attend the thermal needs of the catalytic cracking reactions. The fluidization of the catalyst by gaseous streams makes possible the transport of catalyst between the conversion zone and the regeneration zone and vice-versa. The catalyst, besides its essencial function which is to promote the catalysis of the chemical reactions, is also the means for transporting heat from the regenerator to the conversion zone.

The state-of-the-art is abundant in descriptions of processes for cracking hydrocarbons in a fluidized stream of catalyst, with catalyst transport between the conversion zone and the regeneration zone, and burning of coke in the regenerator. In spite of the long existence of FCC processes, techniques are continually sought which would still improve the process, in order to increase the production of higher priced products such as gasoline and LPG. Generally, it can be stated that the main goal of the FCC processes is the maximization of the production of these more valuable products.

Basically, the maximization of more valuable products is obtained by two methods. One method comprises the increase in the so-called conversion, which corresponds to reduction in the production of heavy products such as the clarified oil and the light cycle oil. Another method comprises reducing the yield in coke and fuel gas, that is, the selectivity of the process to these products is reduced. The consequence of the lower production of coke and fuel gas is the increased production of gasoline and LPG, this meaning increased selectivity of the process to these valuable products. Further benefits are the use of smaller air blower and wet gas compressor which are large dimension, high-consuming energy machinery and which generally determine the limits of the capacity of the FCC units.

It is well-known that an important feature of the FCC process is the initial contact of the catalyst with the feed, this having a paramount influence on the conversion and selectivity to noble products. In the FCC process, the pre-heated hydrocarbon feed is injected near the bottom of a conversion zone or riser, which is an extended, vertical pipe. Generally the height of this pipe is of from 20 to 40 meters while its diameter is of from 0.5 to 1.5 meters. In the riser the feed contacts the flow of regenerated catalyst from which it takes heat in an amount which is sufficient to atomize the feed and provide for the thermal duty of the endothermic reactions which predominate in the process.

After the riser, where the chemical reactions occur, the spent catalyst, having coke deposited on its surface and pores, is separated from the reaction products and sent to the regenerator for burning coke in order to have restored its activity and generate heat which, when transferred from the catalyst to the riser, will be used in the process.

The conditions found at the point where the feed is introduced into the riser determine the products formed in the reaction. At this point there is the initial mixture of the regenerated catalyst and the feed, with the heating up to boiling point and the vaporization of most of these constituents of the feed. The overall residence time of the hydrocarbons in the riser is of just 2 seconds. In order that the catalytic cracking reactions proceed, it is necessary that the vaporization of the feed in the mixing region with the catalyst occur in a few miliseconds, so that the molecules of the vaporized hydrocarbons can contact the catalyst particles. The size of the catalyst particles is around 60 micra and the hydrocarbon molecules permeate through the pores of the particles so as to be affected by the acid sites of the catalyst which ultimately cause the catalytic cracking. In case the quick vaporization is not attained, the liquid fractions of the feed are thermally cracked.

It is well-known that the thermal cracking leads to by-products such as coke and fuel gas, chiefly when residual feeds are cracked. Coke, besides its low intrinsic value, plugs the catalyst pores. Thus, the thermal cracking at the bottom of the riser undesirably competes with the catalytic cracking, which is the actual goal of the process.

On the other hand, the quick vaporization of the feed will be more easily obtained if the feed is suitably atomized, so as to form a fine spray on the catalyst phase. Various models of injectors designed to inject feed into the riser have been developed in order to obtain this spray. There is evidence that the higher the temperature of the feed in the atomizer, the larger will be the surface area of the droplets of the spray and thus the larger will be the contact area between the feed and the catalyst, with significant influence on the ease of vaporization. It can be demonstrated that, for the residual feeds used in the FCC process and for the range of temperatures which is practiced, the increase in contact area with the use of higher feed temperatures can attain 30%.

In order to maximize conversion of the feed it is usual to seek for maximum removal of coke from the catalyst in the regenerator. The combustion of coke may be obtained under partial or total combustion.

Under partial combustion, the gases which are produced by the combustion of coke are made up chiefly of $CO_2$, CO and $H_2O$ and the coke content in the regenerated catalyst is of the order of 0.1 to 0.2 wt %.

Under total combustion, carried out in the presence of a larger excess of oxygen, practically all the CO produced in the reaction is converted into $CO_2$. The oxidation reaction of CO into $CO_2$ is strongly exothermic, so that total combustion occurs with large heat release which results in very high regeneration temperatures. However, total combustion yields a catalyst which contains less than 0.07% and preferably less than 0.05 wt % of coke, which renders it more advantageous as compared to the partial combustion, besides the fact that a high cost boiler for the combustion of CO can be dispensed with.

The increase of coke in the spent catalyst results in an increase of coke under combustion in the regenerator by mass unit of circulated catalyst. Heat is removed from the regenerator in conventional FCC units in the combustion gas and chiefly in the stream of regenerated hot catalyst. An increase in the coke content on the spent catalyst increases the temperature of the regenerated catalyst as well as the difference in temperature between the regenerator and the reaction vessel (reactor). A reduction in the flow rate of regenerated catalyst to the reactor, called catalyst circulation, is therefore necessary in order to provide for the thermal duty of the reactor and keep as such the reaction temperature. However the lower catalyst circulation rate required by the larger difference in temperature between the regenerator and the reactor causes a lowering of the catalyst/oil ratio and reduction of the conversion.

Thus, the catalyst circulation from the regenerator to the reactor is a function of the riser thermal duty and of the temperature which is established in the regenerator, this being a function of the coke production. In view of the fact that the coke which is generated in the riser is affected by the catalyst circulation itself, it can be concluded that the process of catalytic cracking works under a heat balance regime, which, based on the reasons set forth hereinbefore, renders undesirable the operation under a very high regeneration temperature.

There are further limitations to the temperatures which can be tolerated by the FCC catalyst without negatively affecting its activity. Generally, with the modern FCC catalysts, the regenerator temperatures and thus the temperatures of the regenerated catalysts are kept below 760° C., preferably below 732° C., since the loss in activity would be severe beyond this figure. A desirable operation range is between 685° C. and 710° C. The lower limit is controlled mainly by the need of securing suitable coke combustion. For units processing atmopheric residues, the regenerator, were it not for a heat-removing system, would operate at temperatures in the reange of 870–980° C. for most cases.

Therefore, the cooling of the regenerator aims at bringing its temperature to acceptable values from the point of view of the catalyst as well as from the equipments involved and as regards of the establishment of a catalyst circulation of a commercially acceptable range.

This approach is used in FCC units which crack heavy feedstocks such as atmospheric residues or their mixtures with the heavy vacuum gasoil. The cooling of the regenerator is imperative when the available feeds are residual feeds with high coke output and when the regeneration is effected under total combustion.

Total combustion is being increasingly practiced in the field, since among other advantages it leads to a rather low coke content on the catalyst, lower than 0.05 wt %, which improves the conversion.

It should be understood that the processing of increasingly heavy feedstocks, the tendency of such feeds to increase the coke production as well as the operation under total combustion require that catalyst coolers be installed in order to keep the temperature of the regenerator under acceptable limits. Normally the catalyst coolers remove heat from a catalyst stream from the regenerator so that the catalyst stream which returns to the regenerator is substantially cooled.

The cooling of the catalyst has been the object of numerous patents. There are coolers which are internal to the regenerator, their operation being effected through coils, in the interior of which a cooling fluid circulates, see for example U.S. Pat. No. 2,819,951. There are also descriptions of catalyst coolers which are external to the regenerator. U.S. Pat. No. 2,970,117, for example, teaches that the return flow rate of the cooled catalyst to the regenerator can be controlled by means of the regenerator temperature.

A further possibility for removing heat from the regenerator consists in cooling the catalyst which is sent to the riser. This renders the catalyst cooler in the portion of riser which precedes the introduction of feed, with the consequence that the catalyst circulation is increased and the thermal charge of the regenerator is more thoroughly removed, so that the regenerator is cooled.

However, in case there is the need of an additional increase in catalyst circulation so as to achieve higher conversion into noble products, the system will suffer from an excessively low regeneration temperature which renders this operation unsatisfactory. The increase in circulation is desirable in the cracking of residual feeds, since these are feeds of difficult crackability.

In order to prevent that the regenerator temperature be reduced to unacceptable values caused by the increase in catalyst circulation (caused by the heat balance effect as discussed hereinbefore) the temperature of the feed to the riser can be compatibly raised. Under this condition, the thermal duty of the riser is kept similar to the previous condition except that the catalyst is colder and the feed is hotter. This condition does not provide the optimum catalyst circulation, however the difference in temperature between the streams of catalyst and feed is substantially reduced.

The reduction in this driving force of temperature, associated to the increased ease of atomization of the heavy constituents of the feed, made possible by the higher initial temperature and better atomization of the feed, diminishes the occurrence of thermal cracking reactions which yield coke and fuel gas, in the region of mixing between feed and catalyst. These conditions favor the catalytic route which is the basic goal of the FCC process, while minimizing the thermal cracking.

Catalyst can be cooled by using water, however this technique has drawbacks such as the overload of equipments such as the riser, cyclones, the fractionating tower top condensers and the acid waters system; the increased deposition of ammonium salts in the fractionating tower, increased volume of waste waters and energy loss for vaporizing the water which is later recondensed without heat recovery.

In order to eliminate the drawbacks of cooling the riser with the aid of water, a catalyst cooler may be used. The catalyst from the regenerator is cooled in a high-pressure steam generator and from there is directed to the riser. Thus an energetic otimization is created by means of high pressure steam generation. The surplus in steam generation means substantial energy savings, as compared to the injection of water.

U.S. Pat. No. 4,396,531 teaches, in a process for regenerating the FCC catalyst contaminated by coke, an external cooler used to cool the stream of regenerated catalyst to the riser. In the cooler, the hot regenerated catalyst is made to contact under conditions of heat exchange a cooling fluid which is boiler water to yield a relatively cold catalyst, the catalyst being kept in the cooling zone as a dense phase fluidized bed where a fluidizing gas is circulated. It is alleged that the flow rate of the catalyst stream to the cooling zone is adjusted so as to render possible the optimization of the combination of variables which comprises the amount of heat to be removed; the goal of passivation of contaminating metals such as nickel and vanadium; the content of non-condensible gases, which are entrained with the catalyst to the riser. It is stated that the reaction temperature is controlled by means of the flow of relatively cold regenerated catalyst to the reaction zone.

It should be emphasized that by cooling the catalyst directed to the riser, the objective in U.S. Pat. No. 4,396,531 is the cooling of the regenerator by the increase in the catalyst circulation. The main goal of this patent is not the reduction of the thermal cracking with the aid of the cooling of the catalyst which is being directed to the riser and the corresponding heating of the feed, in spite of the fact that is in part achieved. Apparently the teachings of this patent are a counterpart to the numerous patents directed to coolers which return the catalyst to the regenerator, alleging modifications in the thermal properties of the fluids involved in the heat exchange.

When aiming at complying with the specific goal of cooling the regenerator to the required temperature for the adequate operation of the regenerator, the teachings of U.S. Pat. No. 4,396,531 do not lead to the adequate and independent control of the regenerator temperature and of the catalyst circulation, required by the heat balance of the FCC unit, as discussed hereinbefore. U.S. Pat. No. 4,396,531 does not consider the advantage of the adequate interference in the heat balance of the FCC unit. A neat evidence of this is that the control of the reaction temperature is effected by means of the variation of the catalyst flow rate from the cooler to the riser by actuation of valve (21) placed in the corresponding standpipe (5). In U.S. Pat. No. 4,396,531 one cannot find a counterpart which could allow the independent control of the catalyst circulation to the riser, and therefore the catalyst/oil ratio.

Therefore, as regards to the heat balance in a FCC unit, there are several simultaneous parameters to be met: to cool the regenerator keeping its temperature at an adequate value, besides maintaining the catalyst circulation and therefore the catalyst/oil ratio at adequate values which implies obtaining the desired reaction temperature. Thus, U.S. Pat. No. 4,396,531 does not contemplate a degree of freedom which would make the catalyst/oil ratio an independent variable. This is because this patent is not concerned by the heat balance aspects of the unit nor by the advantage of having an independent control of the temperature of the catalyst which contacts the feed and of the temperature of the feed itself.

U.S. Pat. No. 4,234,411 teaches, in a FCC process, a method for the control of the flow rate of two or more regenerated catalyst streams towards the riser. According to the suggested method, the feed to be cracked in the riser is made to contact a first portion of regenerated catalyst where the catalyst flow rate is a function of the temperature of the mixture of this catalyst stream and the feed; then this mixture of feed and catalyst is made to contact a second portion of regenerated catalyst whose flow rate is controlled by the final reaction temperature. In this patent, in spite of the regenerated catalyst being introduced in the riser in two points, in both points the catalyst is at the same temperature. It is the flow rate of catalyst which is varied as a function of the reaction temperature. This patent does not consider in any way altering the heat balance of the unit; it does not take advantage of the existence of cooled catalyst in the region of contact with the feed and of the heated feed. Further, by not acknowledging the principle of the heat balance of the unit this patent does not lead to the independent control of the regenerator temperature, of the feed temperature and of the catalyst/oil ratio.

U.S. Pat. No. 4,257,875 is analogous to U.S. Pat. No. 4,234,411 in that it teaches the introduction of regenerated catalyst in more than one point of the riser. In the described process, the first stream of regenerated recycled catalyst is introduced at a flow rate which is sufficient to bring the temperature of the mixture with feed up to the range of 454° C. and preferably beyond 510° C. so as to atomize most of the distillable portion of the feed. This patent presents a table where the temperature of the feed and the catalyst/oil ratio are the same for the state-of-the-art and the patent, indicating that no modification has been introduced into the heat balance of the unit.

U.S. Pat. No. 5,451,313 teaches a FCC process where the severity of the process is reduced and the feed dispersion and the contact with catalyst are improved by circulating spent catalyst together with regenerated catalyst. Spent and regenerated catalyst are combined so as to near or attain the heat balance between the two catalyst streams before the contact of the catalyst mixture with the feed. The temperature resulting from the mixture between the spent and regenerated catalyst is less than the temperature of regenerated catalyst. It is alleged that the reduced temperature of the catalyst particles together with the increased volume of catalyst promotes a more uniform heating of the feed as well as a better dispersion of feed in the catalyst.

However, there are three main drawbacks which severely restrict the use and benefits of U.S. Pat. No. 5,451,313.

As regards the first of these drawbacks, it is found that when spent catalyst is recycled to the riser, the overall volume of catalyst to be contacted with the feed is increased. This causes that the contact of the feed with the particles of regenerated catalyst is reduced, the regenerated catalyst being the effective catalyst which promotes the reactions of the catalytic cracking. On the other hand, the spent catalyst, having coke deposited on its particles, is a low-activity catalyst. This reduces the conversion of the unit. Besides, the spent catalyst is more coke-selective, since the reactions of coke production are knowlingly catalyzed by the presence of coke, thus the production of undesirable coke is increased. Therefore, the use of a portion of spent catalyst, which induces thermal instead of catalytic cracking, reduces the conversion of the process and worsens its selectivity, this lowering the economics of the process. The process taught in U.S. Pat. No. 5,451,313 could be adequate only for the cracking of light or hydrotreated feeds, having extremely low coke production. Thus, this kind of process is not indicated for the cracking of heavy feedstocks, of increasingly use in the FCC process, these feeds being of difficult crackability, high coke production and which result in catalysts which are highly contaminated by the presence of metals.

A second drawback which limits the use of U.S. Pat. No. 5,451,313 relates to the use of the large recycle flow rate of spent catalyst which is required to the mixture of catalyst at the base of the riser. The fact of it being a recycle, leads to over-dimensioning of the riser, the cyclones, the stripper and the standpipes. Those are large-dimension equipments which bring huge additional costs to a FCC unit. Besides, as a consequence of the increase in the stripper size, it is necessary to increase the flow rate of stripping steam so as to obtain an adequate speed in that equipment. Therefore, operation costs are equally increased.

A third and by no means not less important drawback of the technique addressed in U.S. Pat. No. 5,451,313 relates, as discussed for other patents hereinbefore, to the fact that this patent does not mention aspects relating to the heat balance of the unit. Actually, by using a recycle of spent catalyst to the riser, the heat balance is not altered, since the catalyst is recycled to the beginning of the riser at a temperature which is practically the same as the temperature of the mixture of catalyst and feed at the end of the riser. Therefore, in practical terms, the stream of spent catalyst does not contribute to add or withdraw heat from the riser. In view of the fact that this stream does not alter the heat balance, whenever there is a modification in the feed temperaure, there will be as a consequence a modification in the flow rate of regenerated catalyst to the riser and/or in the regenerator temperature. For example, if there is an increase in the feed temperature there will be a lesser circulation of regenerated catalyst to the riser, as a consequence of the lesser thermal duty of the riser. This occurs even if the temperature of the regenerator is kept at a constant value by means of a catalyst cooler. Therefore, U.S. Pat. No. 5,451,313 cannot benefit from the increase in feed temperature without provoking a reduction in the circulation of regenerated catalyst. The counterpart for keeping the circulation of regenerated catalyst would be by intervening in the heat balance by means of a catalyst cooler. This would entail a reduction in the regenerator temperature, which would have a negative effect on the regeneration. Therefore, the teachings of U.S. Pat. No. 5,451,313 do not allow that the feed temperature, the regenerator temperature and the circulation of catalyst be independent parameters.

Therefore, the patent literature does not teach nor suggests the concept of the present invention, that is, the combination of a stream of hot, regenerated catalyst at the temperature of the regenerator, and a stream of cooled regenerated catalyst, such mixture of catalyst streams being made to contact the feed to be cracked, the catalyst cooler being used to cool the regenerator bed as well as the regenerated catalyst designed to crack the hydrocarbon feed in the riser.

The inventive combination of streams of regenerated catalyst at different temperatures, both being controlled, leads to a mixture of regenerated catalyst having a temperature which is arbitrarily set by the operator of the unit. This feature makes it possible the independent control of the circulation of regenerated catalyst, dissociated from the feed temperature, the regenerator temperature and the reaction temperature as discussed in detail hereinbelow. The inovative action on the heat balance of the unit introduces in the technique a revolutionary concept of independence between the main variables which affect the heat balance of the process of fluid catalytic cracking.

Thus, the need which exists in the art, of a FCC process for heavy feedstocks which would operate under a regime of heat balance, at low cost and yielding high amounts of noble products and low amounts of fuel gas and coke, is provided for by the process which is described and claimed in the present application.

SUMMARY OF THE INVENTION

The present invention comprises a FCC process mainly designed for the cracking of heavy feedstocks, that is, where the boiling point of a substantial amount of the hydrocarbon feed is higher than 570° C. The present invention makes possible to lower the yield of non-desirable products such as coke and gas, while the yield of valuable products such as gasoline and lighter fractions is increased, which improves the economics of the process.

The process of the present invention for the fluid catalytic cracking of heavy feedstocks under conditions of fluid catalytic cracking and in the absence of added hydrogen comprises the following steps:

a) in a conversion zone, contacting a heavy hydrocarbon feed and a catalyst stream which is a mixture formed by two streams of regenerated catalyst at different temperatures, the mixture comprising a main stream of hot regenerated catalyst and a secondary stream of cooled regenerated catalyst, the catalyst mixture having attained an equilibrium temperature, so as to produce hydrocarbons in the vapor phase as a consequence of the catalytic cracking of said feed and coke in the solid phase which is deposited on the catalyst, so as to reduce its activity;

b) separating from the mixture of catalyst streams a stream of cracked hydrocarbons by means of an adequate device placed after the conversion zone or riser;

c) driving the stream of separated catalyst to a stripping zone and then to a regeneration zone and effecting the combustion of coke which has been deposited on the catalyst particles, therefore producing particles of regenerated catalyst the activity of which is higher than the activity of the spent catalyst, at a temperature which is relatively higher than that of the cited mixture of catalyst streams;

d) driving a portion of the hot regenerated catalyst through a catalyst cooler external to the regenerator so as to obtain a stream of cooled regenerated catalyst;

e) driving a portion of the cooled regenerated catalyst to the mixing zone which precedes the conversion zone and return another portion of the cooled regenerated catalyst to the regenerator;

f) driving a portion of the hot regenerated catalyst of step c) to the mixing zone which precedes the conversion zone;

g) combining the streams of hot regenerated catalyst of step c) and cooled regenerated catalyst of step d) in the mixing zone which precedes the reaction zone, thus forming a catalyst mixture at an equilibrium temperature;

h) combining the stream of hot regenerated catalyst of step c) and the stream of cooled regenerated catalyst of step d) with the feed of heavy hydrocarbons to be cracked in the conversion zone, under a regime of heat balance.

The process of the present invention comprises therefore contacting the heavy feed or residue with a mixture of two catalyst streams, the mixture being made up of a main stream of regenerated catalyst from the regenerator, and a secondary, relatively cooler, stream of regenerated catalyst from the catalyst cooler.

The flow rate of the main stream will be controlled by the riser top temperature or by the temperature of the line of products to the fractionating column or else by the temperature of any points between the aforementioned points or still by the stripper temperature.

The temperature of the secondary stream from a catalyst cooler will be controlled either by direct manipulation of the operator on the opening of the valve which is located in the line which transfers this catalyst stream to the riser or automatically by the temperature of the mixture of the two streams of regenerated hot and cooled catalyst to the riser or still by any device which sends to the said control valve a signal which is proportional to the catalyst circulation.

The mixing of the main and secondary streams of regenerated catalyst yields a mixture of regenerated catalyst in the region of the riser which precedes the region of introduction of the feed, the temperature of the mixture of catalyst streams being significantly lower than the temperature of the regenerated catalyst stream directly exiting the regenerator. As a consequence of this lower temperature of the mixed stream of catalyst, the catalytic cracking reactions are favored while the thermal cracking reactions are minimized.

Therefore, the present invention provides a FCC process for the cracking of residues with increased gasoline yield and lowered coke and gas yield as compared to the state-of-the-art processes.

Also, the present invention provides a FCC process where a single catalyst cooler independently cools the catalyst bed of the regenerator as well as the stream of catalyst bound for the riser.

Further, a fundamental aspect of the present invention is to provide for a FCC process which presents a revolutionary modification in the heat balance of the FCC unit. This revolution means that the present invention makes possible that the temperature of the feed may be varied while the regeneration temperature is kept constant and at an ideal value, at the same time that the circulation of regenerated catalyst is also kept constant and at the ideal value. This last feature is not to be found in the state-of-the-art processes.

Thus, according to the present invention, whenever the feed temperature is increased to higher, more desirable levels, the regenerator temperature will be kept at the optimum value by working on the flow of catalyst which is recycled from the cooler to the regenerator. So, under the control of the reaction temperature, the flow of hot catalyst exiting the regenerator will be lowered, as a consequence of the lower difference in temperature between the catalyst stream and the feed.

Further, in contrast to the state-of-the-art practice of the FCC process, the present invention considers avoiding the lowering in circulation of the regenerated catalyst to the riser by acting on the valve controlling the circulation of cooled catalyst to the riser, so as to increase said circulation.

This way, two benefits are superimposed: i) the flow rate of regenerated catalyst is recovered and ii) at the same time a mixture of regenerated catalyst is obtained at the basis of the riser at a temperature which is substantially lower than that obtained in the-state-of-the-art processes.

The so-obtained lower temperature is compatible with the previous regenerated catalyst circulation, which provides for the thermal needs of the riser.

Thus, the catalyst/oil ratio is independently controlled by acting on the flow of cooled catalyst. The same way, the regenerator temperature is independently controlled by the recycle of catalyst to the regenerator, and may be kept at an optimum value.

Therefore, the present invention, makes possible to lower the temperature of the regenerated catalyst stream which contacts the feed of the FCC unit as well as to increase the temperature of the hydrocarbon feed to the riser up to an optimum level. Further, this accomplishment is done by adequately intervening in the heat balance, without prejudice to the modification of other variables which affect the heat balance of the unit, as will be considered in more detail hereinbelow.

So, in a patentably distinguishable way from any other state-of-the-art processes, the acting on the heat balance provided by the present invention brings significant economic benefit which arises from the resulting increase in catalytic cracking at the expense of a lowered thermal cracking, this benefit being specially applicable to heavy feedstocks.

While the control of the flow rate of hot regenerated catalyst to the riser is carried out under the control of the reaction temperature, the control of the flow rate of cooled catalyst to the riser can be effected either by the action of the operator on the opening of the valve of the standpipe of cooled catalyst or automatically by a device which is sensitive to variations in the catalyst circulation, the device acting on the said valve.

Thus, for example, it is well-known that the pressure differential between the base of the riser and its outlet keeps a relationship with the catalyst circulation. Therefore, the catalyst circulation may be automatically controlled by installing a device which is a sensor of the pressure differential at the riser. The signal which is produced by the sensor can be transmitted in a conventional manner, for example electrically or pneumatically. When the signal of that device acts on the valve which controls the flow rate of cooled regenerated catalyst, the automatic control of that flow rate is achieved, so as to keep constant the overall catalyst circulation, which is then freed from the variations in the heat balance of the unit.

Another benefit from the principle of indepence of circulation presented by the present invention is the control of the opening of the cooled catalyst valve to the riser by means of the temperature of the mixture of hot and cooled catalyst streams to the riser. As the catalyst circulation is regulated by the difference in tempeature between the mixture of catalyst streams which meets the feed and the temperature of the feed itself, a process for the control of the catalyst circulation becomes available.

Thus, the present invention further provides a FCC process where the flow rate of a portion of the regenerated catalyst stream, having origin in a catalyst cooler and bound for the riser, whose temperature is substantially lower than the main stream of regenerated catalyst, may be controlled automatically and independtly from the other variables of the unit, this securing the independent control of the catalyst/oil ratio. Such control is not availabe in FCC units of the state-of-the-art, since in conventional FCC processes this variable is a function of the heat balance of the unit (thermal duty of the riser), which does not allow such degree of freedom.

Briefly, the present invention provides a FCC process directed chiefly but not exclusively to heavy or residual feeds, where the temperature of the regenerated catalyst stream at the bottom of the riser is minimized and the temperature of the stream of the hydrocarbon feed at the bottom of the riser is maximized, with the consequence that the difference between the two temperatures is minimized. Therefore it is possible to keep constant and at their optimum values the following variables: the regeneration temperature, the reaction temperature and the catalyst circulation, which are the fundamental variables which secure the highest economics of the FCC process, mainly when residual feeds are being cracked.

Finally, the present invention provides a FCC process where the concept of interdependence of the main variables of the heat balance of the process is profoundly altered by rendering possible the independent control of these variables and therefore their optimization as well as the overall optimization of the process, with evident economic advantage.

DETAILED DESCRIPTION—PREFERRED MODES

Figure 1:
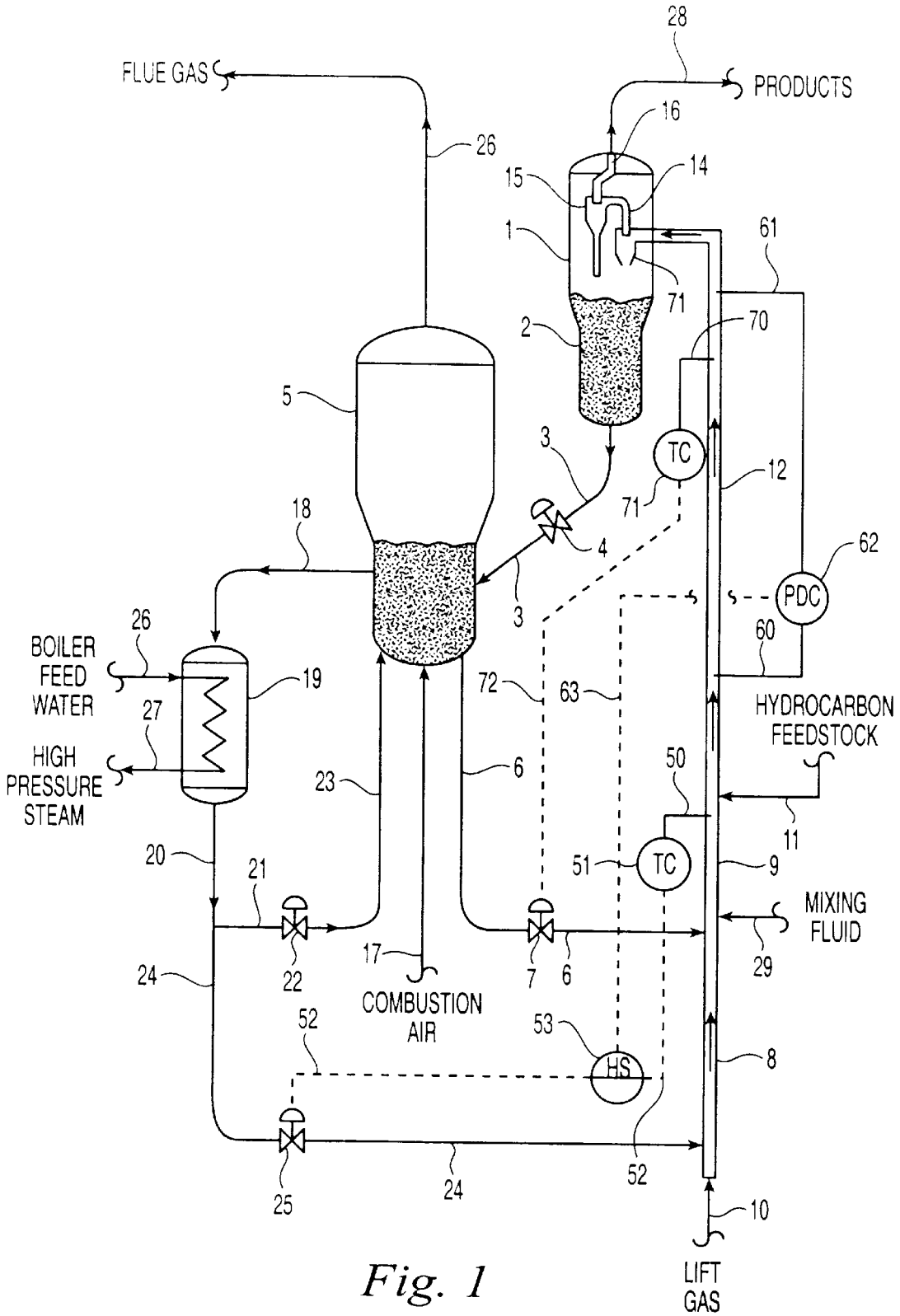
FIG. 1 attached is an elevation, schematic view of a FCC conversion unit according to the present invention, comprising the regenerator, the reaction section and the respective links between the two sections, including the thermal exchange section.

The present invention is a process for the fluid catalytic cracking of heavy feedstocks. The present process is especially directed to high-boiling fractions-containing feeds, for example, beyond 570° C.

Generally, the process described and claimed in the present specification comprises contacting a hydrocarbon feed stream with a stream of regenerated catalyst which in the case of the present invention is a mixture of a main, relatively hotter stream of regenerated catalyst and a secondary, relatively cooler stream of regenerated catalyst, at the bottom of a conversion zone made up of an extended vertical pipe called riser. The contact of the feed with the mixture of regenerated catalyst streams cracks the hydrocarbons, coke being deposited on the catalyst as a by-product. The catalyst on which coke has been deposited is known by the experts as spent catalyst.

After the riser, a stream of cracked hydrocarbons is separated from the catalyst. The cracked hydrocarbons constitute the reaction product and are sent to fractionating systems.

The spent catalyst is sent to a stripper vessel for recovering reaction products which otherwise would be entrained to the regenerator together with the spent catalyst.

Then the spent catalyst is fed to the regenerator. In the regeneration zone occurs the combustion of the coke deposited on the catalyst particles aiming at recovering the catalyst activity and obtain regenerated catalyst particles at high temperature. Most of the heat of the catalyst particles will be used in the riser in order to provide for the thermal duty of heating and vaporization of the feed as well as of the catalytic cracking reactions which are predominantly endothermic.

In view of the fact that the present invention is mainly directed to the cracking of heavy feed, the total combustion regime is preferably used in the regenerator. This makes possible a better regeneration of the spent catalyst upon which a large amount of coke is deposited as a consequence of the cracking of a residual feed. The better regeneration assures to the catalyst an increased activity, which is of paramount importance to the cracking of residual, difficult to crack feeds. As a consequence, the conversion of the process is increased.

A cooler placed externally to the regenerator cools a portion of the regenerated catalyst. A portion of the cooled regenerated catalyst returns to the regenerator where it is mixed to the catalyst bed, to assure, at the balance, an adequate value of regeneration temperature.

Another portion of the cooled regenerated catalyst is directed to the riser where it meets a stream of regenerated catalyst at a temperature substantially higher, straight from the regenerator. The two streams make up the mixture of regenerated catalyst which contacts the feedstock to be cracked. The temperature of the regenerated catalyst which bypasses the cooler is higher than the temperature of the mixture of regenerated catalyst streams which effectively contacts the feed in the riser. In the present invention, the heat exchanger plays not only the conventional role of cooling the regenerator bed, but also an additional role, which is to cool a portion of the catalyst bound to the riser. This is because, under a regime of total combustion, there is the need to operate the regenerator at a temperature which is sufficient to secure the combustion of CO to $CO_2$ in the bed, that ist, preferably beyond 690° C. At temperatures between 690–705° C. it is desirable to cool the catalyst from the regenerator bound for contacting the feed, so as to approximate the temperatures of the catalyst and that of the feed. Thus such difference can be lowered from around 500° C. to as low as 300° C., this being extremely beneficial to lessen the undesirable effects of the thermal cracking.

It is admitted that it is extremely advantageous that a single equipment cools the stream which is recycled to the regenerator as well as the catalyst stream bound to the riser, this latter stream being mixed in the riser with the regenerated catalyst at the temperature of the regenerator bed. However, the process of the present invention may be run with the common use of separate equipment designed to the separate cooling of the two streams.

The catalyst used to the cracking of heavy hydrocarbons may include any of the known catalysts which are normally used in the FCC practice. The preferred catalysts are the zeolites, in view of their high intrinsic activity and their resistance to the deactivating effects of the exhibition to vapor at high temperature and to metals. Normally the zeolites are dispersed in a porous inorganic carrier such as silica, alumina or zirconia. The zeolite content in the catalyst may reach 30 weight % or higher.

In spite of the fact that the present process may be used for feedstocks belonging to the distillation range of the heavy vacuum gasoil, that is, between 380 and 560° C., it is especially directed to residual or heavy feeds where 50 wt % or more of the components distill at a boiling range higher than 510° C. On cracking, such residual feeds show a high degree of coke deposition on the catalyst. The metals present in the feed as well as the coke deactivate the catalyst by blocking or plugging the active sites of the catalyst.

Coke can be removed from the catalyst up to the desired degree by regeneration of the catalyst so as to eliminate its deactivating effects.

The metals, however, accumulate on the catalyst and poison it, melting inside the catalyst so that the reactive sites are permanently blocked. Besides, the metals promote undesirable cracking so that the reactive process is disturbed. Thus, the presence of metals normally exerts an influence on the operation of the regenerator, the catalyst selectivity, the catalyst activity and the amount of fresh catalyst required to keep a constant activity. The contaminating metals include nickell, iron and vanadium. Generally, such metals negatively affect the selectivity towards less gasoline and more coke.

According to the mode illustrated in the arrangement of FIG. 1 attached, the FCC process of the present invention comprises a reactor 1, a regenerator 5, a catalyst cooler 19, and an extended reaction zone or riser 12 which provides a conversion zone. The catalyst circulation as well as the contact of the catalyst with the feed proceed according to the following description.

Thus, from regenerator 5 extends a pipe 6 which allows the passage of hot regenerated catalyst to the bottom 8 of riser 12 and a pipe 18 which allows the passage of hot regenerated catalyst to cooler 19. From the cooler 19 extends a pipe 20 which is connected to pipe 24 provided with control valve 25 which conveys a portion of the cooled regenerated catalyst to the bottom 8 of riser 12. Pipe 20 is also connected to pipe 21, which by means of control valve 22 connected to pipe 23 conveys a portion of the cooled regenerated catalyst to the regenerator so as to cool the bed of the regenerator.

A fluidizing lift gas introduced via a pipe 10 is made to contact the catalyst at the bottom 8 of the riser 12, so as to keep the catalyst in a fluidized state. The distribution of the lift gas throughout the bottom 8 of the riser 12 is preferably effected thorough a perforated ring or else through a perforated plate which are distribution means well-known from the experts. The mixture of the hotter stream of catalyst and the cooler stream of catalyst occurs In the half height 9 of riser 12. Preferably the ratio between the mixture of regenerated catalyst in portion 9 of riser 12 and the feedstock—stream 11—which contacts the catalyst in the first portion of riser 12 is between 4 and 15, more preferably between 6 and 9.

In view of the fact that the stream of regenerated catalyst, which derives from the mixture of streams 6 and 24 is at a lower temperature than the not-cooled stream of regenerated catalyst of the state-of-the-art, the feedstock can be introduced into the riser 12 at a higher temperature than that which is usually practiced in the state-of-the-art processes, so that the feedstock is quickly vaporized and in a more homogenously way than that usually practiced.

In the Example which accompanies this specification, the feedstock temperature which in the state-of-the-art is 240° C. is increased to 360° C. in the present invention. Mathematical simulation shows that this increase in temperature of the feedstock made up of atmospheric residue means an increase of more than 30% in the contact area between the catalyst and the feed spray provided by the feedstock atomizer. The temperature differential between the catalyst and the feed is also substantially lower than in the state-of-the-art processes, this being an additional positive effect by avoiding excess of localized heating of the feedstock. The combined two effects contribute to minimize the undesirable thermal cracking.

The hot regenerated catalyst shows a temperature which is substantially higher than the relatively cold regenerated catalyst which leaves the cooler. The hot regenerated catalyst which leaves pipe 6 will normally be at a temperature in the range of 650 to 760° C. and preferably in the range of 680 to 732° C.

The cold regenerated catalyst which exits cooler 19 will normally be at a temperature in the range of 450 to 670° C. and preferably in the range of 480 to 520° C.

The ratio of hot regenerated catalyst to cooled regenerated catalyst which contacts the hydrocarbon feedstock in the riser is between 10:1 and 2:1, preferably between 6:1 and 4:1.

The resulting temperature of the mixture of hot and cooled catalyst streams in the riser is in the range of 630 to 670° C., preferably between 640 and 660° C.

The residence time of the catalyst particles in the riser varies between 0.3 and 8 seconds, preferably between 1 and 5 seconds.

The riser is made up of portions 8, 9 and 12. Portion 12 provides a conversion zone for the cracking of the hydrocarbon feedstock. The conversion zone comprises a vertical pipe for pneumatic conveying of the mixture of a stream of hot regenerated catalyst from the regenerator and a stream of cooled regenerated catalyst from the catalyst cooler. The feedstock is introduced in the riser typically in the first portion of 12 by means of injection nozzles placed in stream 11, which for the sake of simplicity are not described herein. Before contacting the catalyst, the feedstock is at a temperature between 100 and 450° C., preferably between 240 and 360° C.

The reaction temperature is monitored at the end of riser 12, generally in the range between 510 and 570° C., preferably between 520 and 560° C. This control is effected by means of a well-known device 70 for measuring temperature which is associated to a monitor 71 and to a signal transmission device 72 which acts on control valve 7. Thus, for each desired temperature value designed for monitor 71, such desired value is compared to the measured value. As a consequence, the monitor acts on the opening of valve 7, so as to accordingly vary the flowrate of hot regenerated catalyst to be directed to the riser. For each corrected opening of valve 7, which could alter the catalyst/oil ratio, the process of the present invention, opposite to the state-of-the-art processes, allows a change in the opening of valve 25, so as to admit into the riser a modified flowrate of cooled regenerated catalyst so as to remake the previous catalyst/oil ratio.

The reacted mixture made up of spent catalyst and the hydrocarbon vapors produced by the cracking reaction is then discharged from the end of the riser, carried through the separating catalyst device made up of parts 13, 14 and 15. The schematic representation of such separation device refers to a cyclone separator; however, any arrangement of separators may be employed to remove spent catalyst from the product hydrocarbon stream. The hydrocarbons flow to pipes 16 and 28, and are then directed to the fractioning section for recovery of the usual products of a catalytic cracking unit.

The catalyst particles on which coke has been deposited (spent catalyst) flow through the bottom of devices 13 and 15 towards the containment vessel 1 wherefrom they reach an extension of the containment vessel 1 which is the stripper 2, where counter-current steam removes the hydrocarbons which are adsorbed on the catalyst surface. The catalyst substantially free of hydrocarbon vapors leaves the stripping section through a pipe 3. The flow of catalyst is controlled by a valve 4, the opening of which is controlled by the stripper level.

The spent stripped catalyst is conveyed through pipe 3 to regenerator 5, so as to form a fluidized bed, where occurs the expected combustion of the coke deposited on the surface of the catalyst particles. Combustion is effected by contact with an oxygen gas, usually air, which enters regenerator 5 through an entrance at the bottom of the regenerator, stream 17. Cyclone separators, placed generally internally to the regenerator, for the sake of simplicity not represented, remove catalyst particles entrained by the combustion gas, rendering them to the catalyst bed before the exit of the gas. The combustion of coke from the catalyst particles heats the catalyst as well as the combustion gases.

The catalyst cooler is an equipment external to the regenerator for removing heat from the regenerated catalyst by heat exchange with a fluid which is normally external to the process. In the present invention, the catalyst cooler 19 is linked to the regenerator 5 by means of a pipe 18 which conveys to the catalyst cooler 19 a flow of hot catalyst from the regenerator 5. The catalyst cooler can be any state-of-the-art equipment for the thermal exchange involving fluidized solids and another fluid. Generally, the cold fluid will be boiler feed water, which in FIG. 1 is represented by stream 26, there occurring the generation of steam, fluid 27.

According to the preferred mode of the present invention as illustrated in FIG. 1, the catalyst cooler 19 plays a double role: to cool not only stream 21 of regenerated catalyst which returns to the regenerator 5, but also the regenerated catalyst stream 24 which will be directed to the riser and which should crack the feedstock of heavy hydrocarbons. The control of the flowrate of the two streams is effected independently.

Thus, the process concept suitable to the cracking of residual feedstocks according to the present invention comprises, besides stream 6 of hot regenerated catalyst from the regenerator 5 and directed to the riser, and stream 21 of cool regenerated catalyst which returns to the regenerator 5, a stream 24 of cool regenerated catalyst bound to the riser, so that stream 24 and stream 6 form a mixture which is the catalyst stream which flows through portion 9 of the riser, this being the mixture with which the feedstock is effectively contacted.

Portion 9 of the riser is long enough to secure that the heat balance between the two catalyst streams 24 and 6 be attained. Portion 9 is from 5 meters to 15 meters long, preferably from 7 meters to 10 meters long. In order to secure thorough and quick admixture between the two streams of regenerated catalyst, a mixing fluid, stream 29 is injected in portion 9 this fluid being water, steam or any other gaseous fluid such as for instance fuel gas. The fluid is injected through nozzles which are radially placed, forming an angle of 30 to 60°, preferably 40 to 55°, with the cylindric wall of portion 9. These nozzles amount from 2 to 12, preferably from 4 to 8, according to the size of the unit, and are placed in the beginning of portion 9, that is, at a short distance from the site where stream 6 is introduced. The exit rate of the mixing fluid through said nozzles is adjusted at a value which is sufficient to secure a suitable mixing energy. The flowrate of stream 29 is adjusted at a value which is sufficient to secure plug flow of catalyst through portion 9, at moderate density. The ratio of this latter flowrate to the flowrate of gas lift injected into portion 8 of the riser is 80:20 to 60:40. In the intersection between portions 9 and 12 which is the site where the feedstock stream 11 is introduced, the pipe diameter is enlarged, this enlargement not being represented in the FIGURE for the sake of simplicity.

According to the present invention, the flowrate of the main catalyst stream 6 from regenerator 5, such stream 6 being at a relatively higher temperature, can be controlled by the temperature of the top of the riser while the flowrate of secondary catalyst stream 24, from the catalyst cooler 19 and at a relatively lower temperature, in one mode can be controlled by the temperature of stream 9. Stream 9 is the stream resulting from the mixture of hot regenerated catalyst stream and cooled regenerated catalyst. In this case a state-of-the-art device 50 for the measurement of temperature coupled to a control device 51 transmit a signal by means of device 52, through signal key 53 to control valve 25.

In another mode, the flowrate of stream 24 will be controlled for example by means of a device which is sensitive to the pressure differential existing in the riser. In this cae, state-of-the-art devices 60 and 61 for measuring pressure situated respectively at the beginning and at the end of portion 12 of the riser, coupled to a state-of-the-art control device 62 transmit a pressure differential signal through device 63, through signal key 53 to device 52 and from then to valve 25.

The signal key 53 is a state-of-the-art device used in the instruments technique which makes possible to select the desired control mode of operation.

According to a third mode, the flowrate of stream 24 may be controlled by means of direct action of the operator on the valve opening, depending on the overall desired catalyst circulation. However, the flowrate of stream 24 may be controlled by any other method of flowrate control, since one of the main features of the present invention is the independent control of the flowrate of such stream, which consequently securing the independent control of the catalyst circulation.

Thus, as the temperature reached by the mixture of the two catalyst streams 24 and 6 is lower than the temperature of stream 6 originating from the regenerator 5, the temperature of the feedstock directed to the riser may be increased. Thus, the sum of the two effects, that is, the reduction in temperature of the catalyst stream and the increase in temperature of the feedstock leads favorably to the minimization of the thermal cracking which in turn reduces the yield of fuel gas and coke, with the consequent increase in gasoline.

Figure 2:
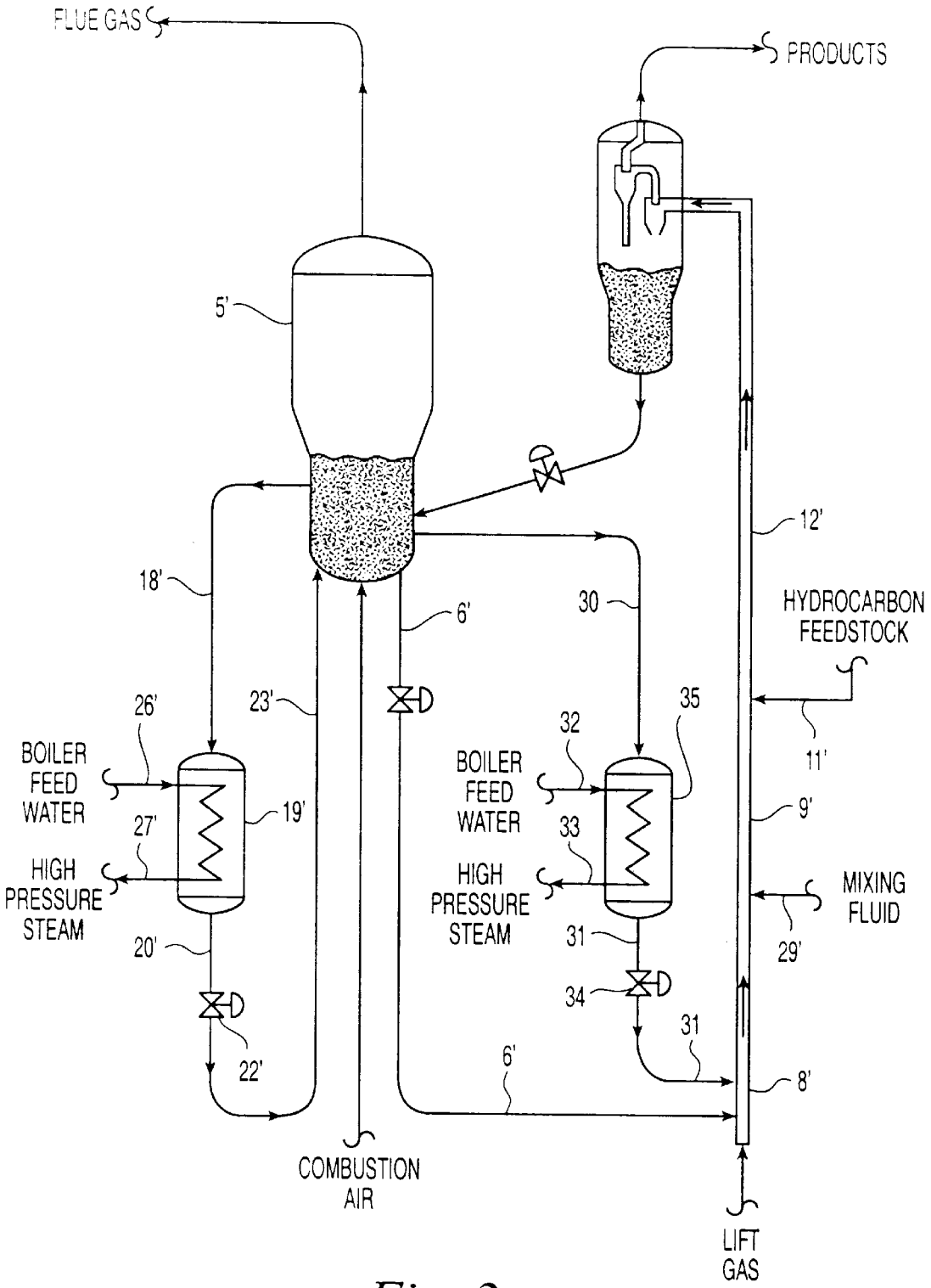
FIG. 2 attached is an elevation, schematic view of a FCC conversion unit according to the present invention, similar to FIG. 1, where the thermal exchange section has been modified.

In another preferred mode of the present invention as illustrated in FIG. 2, a catalyst cooler may be used to exclusively cool the catalyst stream sent to the riser, while another catalyst cooler cools the catalyst stream which is recycled to the regenerator. Thus, according to said FIG. 2, the regenerated catalyst stream 18' is fed to catalyst cooler 19' which uses as cooling means a cold fluid which is typically boiler feed water. Cooled catalyst stream 20' crosses valve 22' and returns to regenerator 5' through pipe 23' keeping the regenerator vessel under temperature control. Stream 30 from regenerator 5' is fed to another catalyst cooler 35 transferring heat to a cold fluid 32 such as boiler feed water and thus generating high pressure steam 33. The cooled regenerated catalyst stream 31 so obtained is sent to the riser where it is admixed to the hot regenerated catalyst stream 6' which rises through portion 8' of the riser. The catalyst mixture rising through portion 9' meets the mixing fluid 29' and then the hydrocarbon feedstock 11' with which it will react in portion 12'. Compared to the first mode of the invention, this second mode advantageously offers the possibility of sending a stream of cooled catalyst to the reaction riser at a temperature which is different from the temperature of return of the cooled catalyst to the regenerator, with the consequent increased operation flexibility.

Figure 3:
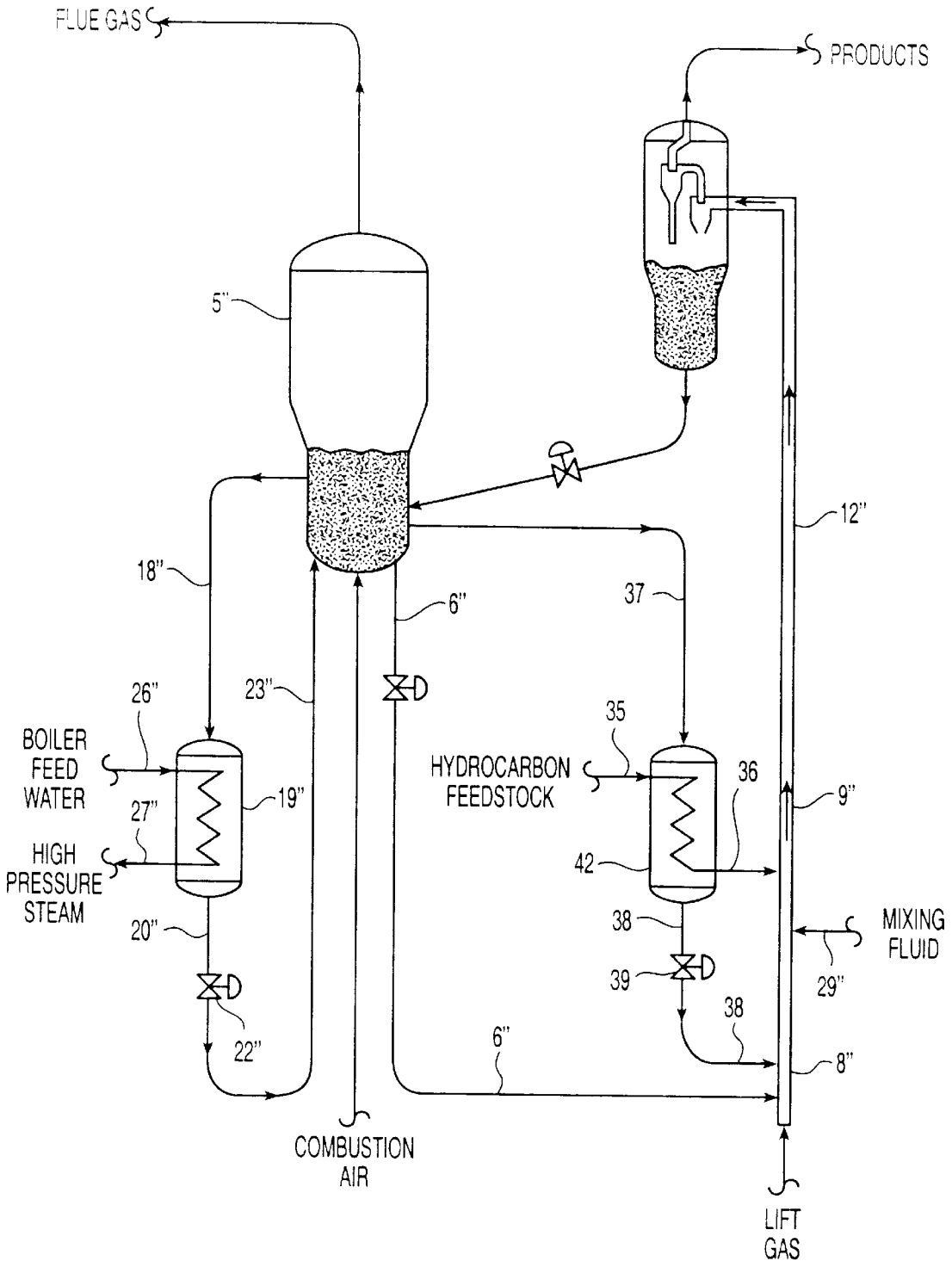
FIG. 3 attached is an elevation, schematic view of a FCC conversion unit according to the present invention, similar to FIGS. 1 and 2, showing a third mode of configuration for the thermal exchange section.

According to a third preferred mode of the present invention, as illustrated in FIG. 3, the cooler which exclusively cools the catalyst stream sent to the riser can do it by means of the heat exchange between the catalyst and the hydrocarbon feedstock of the cracking unit. This way, in the existing units, the need to enlarge the feedstock furnace of the unit is avoided. Thus, according to FIG. 3 stream 18" of regenerated catalyst is fed to a catalyst cooler 19" which uses a cold fluid 26" such as boiler feed water. The cooled catalyst stream returns through pipe 23" to regenerator 5" keeping this vessel under temperature control in a way which is similar to that illustrated in FIG. 2. Catalyst cooled stream 38 to riser 12" is obtained passing stream 37 of regenerated catalyst through catalyst cooler 42. In this third mode the cooling medium is the feedstock itself, stream 35 which after receiving heat from the catalyst stream turns into stream 36 which on being injected into the riser contacts the catalyst mixture which rises through portion 9" of the riser.

The present invention will now be illustrated by the following Example, which should not be construed as limiting it.

EXAMPLE

Tests were effected in semi-industrial units as well as by simulation are listed in TABLE I below. These tests compare data of catalytic cracking for a residue feedstock of difficult crackability submitted to a state-of-the-art process as well as to a process according to the present invention. The main features of the feedstock are depicted in TABLE III.

In TABLE I, on the column corresponding to Case A which illustrates a state-of-the-art process, the temperature of the catalyst bed is 690° C. The reaction temperature is 560° C. The feedstock temperature is 240° C. The catalyst/oil ratio, which is a function of the cited three temperatures, is 7.9. As a consequence, the difference between the temperature of the regenerated catalyst and the feedstock temperature is 450° C. The feedstock temperature, 240° C., is rather low considering the cracking of residue-containing feedstocks. This renders more difficult the quick vaporization of the feedstock in the riser, which depends then on a thorough contact between catalyst and feedstock, which in practice does not occur. As a consequence the reactions undergone by the feedstock will be directed mainly to a mode of thermal cracking, with increased coke and fuel gas. On the other hand, the temperature of the regenerated catalyst, in spite of being satisfactory for regeneration, is excessively high for the locus where it contacts the feedstock, so that thermal cracking results once more.

Since the conditions of Case A whose yields are listed in TABLE II were not satisfactory, the operator increased the temperature of the feedstock to 290° C. according to Case B, which equally illustrates a state-of-the-art technique. By increasing the flowrate of the catalyst stream effluent from the catalyst cooler which returns to the regenerator, the temperature of the regenrator has been kept at the adequate value of 690° C. The difference in temperature betwen the regenerated catalyst and the feedstock was lowered from 450° C. to 400° C. so that thermal cracking was reduced. However, in view of the new heat balance dictated by the lower thermal demand of the riser, the catalyst circulation was reduced from 36.8 to 30.2 ton/minute. Thus, the catalyst/oil ratio was reduced from 7.9 to 6.5. Since the effect of the catalyst/oil ratio on the overall yield was more important than the reduction in thermal cracking, the gasoline yield, which is the main objectlve of the process, was lowered from 38% to 36.5 wt %, as listed in TABLE II, which means poor economic results.

Turning now to the column which lists the conditions of Case C in TABLE I, there are illustrated the features of the present invention. It is found that the feedstock temperature has been raised to 360° C. As previously, by increasing the flowrate of regenerated catalyst the regenerator temperature of 690° C. has been kept as such. By working on the valve which controls the flowrate of cooled regenerated catalyst to the riser, either manually or automatically as described hereinbefore, a catalyst circulation is admitted at a rate of 7.7 ton/min at a temperature of 500° C. In the riser this catalyst stream is admixed to the regenerated catalyst straight from the regenrator at a temperature of 690° C. The resulting mixture of cold and hot catalyst streams reaches the equilibrium temperature at 647° C. Such equilibrium temperature defines a total circulation of 36.8 ton/minute, exactly as in Case A, therefore having the same catalyst/oil ratio 7.9. However, the difference between the temperatures of feedstock and catalyst has been lowered from 450 to 287° C., the thermal cracking being significantly reduced, and this, keeping the catalyst/oil ratio at the optimum value of 7.9. This performance is unknown in the state-of-the-art processes. Also, the increase in the temperature of the feed from 240 to 360° C. additionally favors the decrease in thermal cracking since the contact area of vaporized feed and catalyst increases more than 30%, due to a better operation of the feedstock atomizer. As a consequence, the yields listed in TABLE II show an increase of from 38.0 wt % to 39.7 wt % (4.5 wt %) in the gasoline yield, mainly as a result of a decrease of from 7.0 to 5.6 wt % (20 wt %) in the fuel gas yield.

For an averaged-sized FCC unit processing 7,000 cubic meters a day ($m^3$/d), the inventive process results in extra benefits of the order of U.S. $ 3.4 millions a year, based on Case A or of U.S. $ 5.3 millions a year, based on Case B.

It should be understood that the Examples of Table I below are in no case limiting, since, contrary to the state-of-the-art, in Case C which illustrates the present invention, any combinations of catalyst circulations may be arbitrarily defined between the two standpipes, so as to secure the desired catalyst/oil ratio instead of the ratio which is forced by the heat balance of the unit. According to the same reasoning, any other feed temperature could have been selected in Case C, without any harm to the catalyst/oil ratio. In the Example, the temperature of 360° C. was selected in view of it being near the maximum temperature from which thermal cracking may occur in the feed furnace for the feedstock of the Example.

TABLE I

| | | STATE-OFTHE-ART | | INVENTION |
|---|---|---|---|---|
| STREAM | PARAMETER | Case A | Case B | Case C |
| 28 | Reaction Temp. ° C. | 560 | 560 | 560 |
| 11 | Feed Temp. ° C. | 240 | 290 | 360 |
| 6 | Regeneration Temp. ° C. | 690 | 690 | 690 |
| 24 | Temp. Cooled Catalyst, ° C. | — | — | 500 |
| 9 | Total Catalyst, Temp. ° C. | 690 | 690 | 647 |
| — | Δ t (cat-feed), ° C. | 450 | 400 | 287 |
| 6 | Hot catalyst circulation, ton/min | 36.8 | 30.2 | 29.1 |
| 24 | Cold Catalyst circulation, ton/min | — | — | 7.7 |
| 9 | Total circulation ton/min | 36.8 | 30.2 | 36.8 |
| — | Catalyst/oil ratio, w/w | 7.9 | 6.5 | 7.9 |

TABLE II

| | STATE-OF-THE-ART | | INVENTION Case C |
|---|---|---|---|
| Products | Case A | Case B | wt % |
| $H_2S$ | 0.7 | 0.7 | 0.7 |
| Fuel Gas | 7.0 | 6.4 | 5.6 |
| LPG | 11.5 | 11.5 | 11.8 |
| Gasoline | 38.0 | 36.5 | 39.7 |
| LCO | 16.1 | 17.0 | 16.1 |

TABLE II-continued

| Products | STATE-OF-THE-ART Case A | STATE-OF-THE-ART Case B | INVENTION Case C wt % |
|---|---|---|---|
| Clarified Oil | 16.1 | 17.9 | 16.1 |
| Coke | 10.6 | 10.0 | 10.0 |
| Total | 100.0 | 100.0 | 100.0 |

TABLE III

| Stream | Atmospheric Residue |
|---|---|
| Origin of Oil | Cabiúnas |
| Density, ° API | 15.1 |
| Density, 20/4° C. | 0.9615 |
| Conradson Carbon | |
| Residue, wt % | 10.0 |
| Sulphur, wt % | 0.70 |
| Basic Nitrogen, ppm | 1906 |
| Nickel, ppm | 21.1 |
| Vanadium, ppm | 22.4 |
| Asphaltenes, wt % | 4.9 |
| VABP, ° C. | 528.6 |

We claim:

1. A process for the fluid catalytic cracking of heavy feeds under conditions of fluid catalytic cracking and in the absence of any added hydrogen, which comprises the following steps:

a) contacting a heavy hydrocarbon-containing feed and a catalyst stream in a conversion zone or riser, where the catalyst stream is a mixture of two regenerated catalyst streams, such streams being at different temperatures and such mixture comprising a main catalyst stream of hot regenerated catalyst and a secondary catalyst stream of cooled regenerated catalyst, the catalyst mixture having attained an equilibrium temperature, said contacting being such as to yield vapor phase hydrocarbons from the catalytic cracking of such feed as well as coke in a solid phase which is deposited on the catalyst, so as to reduce its activity;

b) from said mixture of catalyst streams, separating a stream of cracked hydrocarbons by means of adequate devices placed beyond the conversion zone or riser;

c) conveying said separated catalyst stream to a stripping zone, then to a regeneration zone and effecting the combustion of the coke deposited on the catalyst particles so as to obtain particles of regenerated catalyst of higher activity based on the spent catalyst, at a temperature which is relatively higher than the temperature of the said catalyst mixture;

d) conveying a portion of the hot regenerated catalyst stream from step c) to a catalyst cooler which is external to the regenerator and the stripping zone so as to obtain a stream of cooled regenerated catalyst stream;

e) conveying a portion of the cooled regenerated catalyst from step d) to the mixing zone which precedes the conversion zone or riser while returning another portion of the cooled regenerated catalyst stream to the regenerator;

f) conveying a portion of the hot regenerated catalyst stream from step c) to the mixing zone which precedes the conversion zone or riser, so as to form a catalyst mixture at an equilibrium temperature;

(g) combining the stream of hot regenerated catalyst of step (c) and cooled regenerated catalyst of step (d) in the mixing zone which precedes the reaction zone, thus forming a catalyst mixture at an equilibrium temperature; and h) combining the hot regenerated catalyst stream of step c) and the cooled regenerated catalyst stream of step d) and the heavy feed to be cracked in the conversion zone or riser, under a heat balance regime.

2. A process for the fluid catalytic cracking of heavy feeds according to claim 1, wherein the heavy hydrocarbon feedstock is a feedstock having boiling point between 380 and 560° C. and °API between 8 and 28.

3. A process for the fluid catalytic cracking of heavy feeds according to claim 1, wherein the catalyst/oil ratio is independently controlled by controlling the flowrate of the cooled catalyst stream.

4. A process for the fluid catalytic cracking of heavy feeds according to claim 1, wherein the regenerator temperature is independently controlled by the recycle of cooled catalyst to the regenerator.

5. A process for the fluid catalytic cracking of heavy feeds according to claim 1, wherein the hot regenerated catalyst stream of step c) is at a temperature between 650 and 760° C.

6. A process for the fluid catalytic cracking of heavy feeds according to claim 5, wherein the hot regenerated catalyst stream of step c) is at a temperature between 680 and 732° C.

7. A process for the fluid catalytic cracking of heavy feeds according to claim 1, wherein the cooled regenerated catalyst stream of step d) is at a temperature between 450 and 670° C.

8. A process for the fluid catalytic cracking of heavy feeds according to claim 7, wherein the cooled regenerated catalyst stream of step d) is at a temperature between 480 and 520° C.

9. A process for the fluid catalytic cracking of heavy feeds according to claim 1, wherein the admixture of catalyst streams of steps c) and d) in the conversion zone of riser yields a temperature in the range of from 630 to 670° C.

10. A process for the fluid catalytic cracking of heavy feeds according to claim 9, wherein the admixture of catalyst streams of steps c) and d) in the conversion zone of riser yields a temperature in the range of from 640 to 660° C.

11. A process for the fluid catalytic cracking of heavy feeds according to claim 1, wherein the residence time of the catalyst particles in the conversion zone or riser is between 0.3 and 8 seconds.

12. A process for the fluid catalytic cracking of heavy feeds according to claim 11, wherein the residence time of the catalyst particles in the conversion zone or riser is between 1 and 5 seconds.

13. A process for the fluid catalytic cracking of heavy feeds according to claim 1, wherein the ratio of the hot regenerated main catalyst stream to the cooled regenerated secondary catalyst stream is from 10:1 to 2:1.

14. A process for the fluid catalytic cracking of heavy feeds according to claim 13, wherein the ratio of the hot regenerated main catalyst stream to the cooled regenerated secondary catalyst stream is from 6:1 to 4:1.

15. A process for the fluid catalytic cracking of heavy feeds according to claim 1, wherein the flowrate of the hot regenerated main catalyst stream to the riser or conversion zone is controlled so as to secure the independent control of the catalyst circulation.

16. A process for the fluid catalytic cracking of heavy feeds according to claim 15, wherein the flowrate of the hot regenerated main catalyst stream to the riser or conversion zone is controlled by the riser or conversion zone top temperature riser.

17. A process for the fluid catalytic cracking of heavy feeds according to claim 15, wherein the flowrate of the hot regenerated main catalyst stream to the riser or conversion zone is controlled by the temperature of the hydrocarbon separation device effluent.

18. A process for the fluid catalytic cracking of heavy feeds according to claim 15, wherein the flowrate of the hot regenerated main catalyst stream to the riser or conversion zone is controlled by the stripper temperature.

19. A process for the fluid catalytic cracking of heavy feeds according to claim 1, wherein the flowrate of cooled regenerated secondary catalyst stream from the catalyst cooler is controlled by hand actuation or automatic control of a valve opening situated in a pipe which transfers the catalyst stream from the catalyst cooler to the area which precedes the mixing zone between the streams of hot regenerated catalyst and cooled regenerated catalyst.

20. A process for the fluid catalytic cracking of heavy feeds according to claim 19, wherein the opening of the valve which regulates the flowrate of the secondary stream of cooled regenerated catalyst from the catalyst cooler is controlled automatically by the temperature of the mixture of streams of hot regenerated catalyst and cooled regenerated catalyst to the riser or the conversion zone.

21. A process for the fluid catalytic cracking of heavy feeds according to claim 19, wherein the opening of the valve which regulates the flowrate of the secondary stream of cooled regenerated catalyst from the catalyst cooler is controlled automatically by the pressure differential between the bottom and the end of the riser or conversion zone.

22. A process for the fluid catalytic cracking of heavy feeds according to claim 1, wherein the flowrate of the secondary stream of cooled regenerated catalyst from the catalyst cooler is controlled.

23. A process for the fluid catalytic cracking of heavy feeds according to claim 1, wherein the regenerated catalyst stream which is a mixture of the hot regenerated main catalyst stream and cooled regenerated secondary catalyst stream makes possible that the feed may enter the conversion zone or riser at a temperature as high as 360° C. so that the feed is vaporized in a homogenous way.

24. A process for the fluid catalytic cracking of heavy feeds according to claim 23, such process is operated at catalyst/oil ratio as high as 7.9.

25. A process for the fluid catalytic cracking of heavy feeds according to claim 1, wherein in step a) the area of mixture of the hot regenerated catalyst stream and the cooled regenerated catalyst stream comprises a pipe, said pipe having a diameter which is lower than the diameter of said conversion zone.

26. A process for the fluid catalytic cracking of heavy feeds according to claim 23, wherein the homogenization of the catalyst streams in said mixing area is effected under a plug flow regime.

27. A process for the fluid catalytic cracking of heavy feeds according to claim 26, wherein said plug flow and the homogenization of the catalyst streams is obtained by the injection of a gaseous fluid through nozzles which are radially placed in said mixing area.

28. A process for the fluid catalytic cracking of heavy feeds according to claim 27, wherein said gaseous fluid is steam.

* * * * *